US006492764B2

(12) United States Patent
Takeda et al.

(10) Patent No.: US 6,492,764 B2
(45) Date of Patent: Dec. 10, 2002

(54) METAL HALIDE LAMP

(75) Inventors: Kazuo Takeda, Osaka (JP); Yoshiharu Nishiura, Shiga (JP); Takashi Maniwa, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/912,712

(22) Filed: Jul. 25, 2001

(65) Prior Publication Data

US 2002/0067132 A1 Jun. 6, 2002

(30) Foreign Application Priority Data

Aug. 29, 2000 (JP) ..... 2000-259417

(51) Int. Cl.[7] ..... H01J 1/02; H01J 61/30
(52) U.S. Cl. ..... 313/25; 313/623; 313/634
(58) Field of Search ..... 313/25, 238, 239, 313/283, 623, 634, 637, 638, 639

(56) References Cited

U.S. PATENT DOCUMENTS 5,021,703 A * 6/1991 Passmore et al. ..... 313/25
5,122,706 A * 6/1992 Parrott et al. ..... 313/25
5,424,609 A 6/1995 Geven et al. ..... 313/623
6,137,229 A * 10/2000 Nishiura et al. ..... 313/634
6,153,968 A * 11/2000 Dombrowski et al. ..... 313/238
6,157,131 A * 12/2000 Nelson et al. ..... 313/634
6,291,933 B1 * 9/2001 Dombrowski et al. ..... 313/25
6,329,742 B1 * 12/2001 Nelson et al. ..... 313/25

FOREIGN PATENT DOCUMENTS

JP 7-192699 7/1995 ..... H01J/61/50
JP 8-50880 2/1996 ..... H01J/61/30
JP 9-92219 4/1997 ..... H01J/61/50
JP 11-283572 10/1999 ..... H01J/61/52

* cited by examiner

*Primary Examiner*—Hoang Nguyen
(74) *Attorney, Agent, or Firm*—Merchant & Gould P.C.

(57) ABSTRACT

A metal halide lamp including a discharge tube of a transparent ceramic in which a discharge metal and a buffer gas are sealed, the discharge tube having electrodes at both ends thereof, including a discharge portion, slender tube portions provided at both ends of the discharge portion, into which feedthroughs including the electrodes and lead-in wires are inserted, and slender tube sealing portions in which gaps between the slender tube portions and the feedthroughs are sealed with a sealing material, an outer tube containing the discharge tube, and a transparent protecting cylinder provided inside the outer tube so as to surround the discharge tube is provided. At least one of the slender tube sealing portions is exposed beyond the protecting cylinder. This provides a metal halide lamp that suppresses leaks in a discharge tube sealing portion while maintaining high efficiency and high color rendition by using a ceramic discharge tube, and that is tolerant of an external shock.

12 Claims, 5 Drawing Sheets

METAL HALIDE LAMP

BACKGROUND OF THE INVENTION

1. Field of the Invention

The present invention relates to a metal halide lamp using a ceramic discharge tube.

2. Description of Related Art

In metal halide lamps provided with a ceramic discharge tube, there is less reactivity between a discharge tube material and enclosed metals compared to metal halide lamps having a quartz discharge tube, which has been in general use so far. Therefore, it is expected that stable lifetime characteristics can be obtained for the metal halide lamps using a ceramic discharge tube.

Conventionally, metal halide lamps having a discharge tube in which both end portions of a transparent alumina tube are closed by insulating ceramic caps or conducting caps are proposed as such metal halide lamps (see JP 62-283543 A).

Further proposed are metal halide lamps having a ceramic discharge tube having slender tube portions at both end portions of a discharge portion and having a smaller diameter than the discharge portion (see JP 6-196131 A). Electrically conductive lead wires having an electrode at their tips are inserted at the slender tube portions. The gaps between the end portions of the slender tube portions and the electrically conductive lead wires are sealed with a sealing material.

Such conventional metal halide lamps using a ceramic discharge tube utilize the high thermal resistance of the ceramic to raise a tube-wall load (lamp power per surface area of the entire discharge tube) compared to metal halide lamps having a quartz discharge tube, thereby improving the lamp efficiency. In such metal halide lamps, a technology is proposed in which the entire discharge tube is covered with a transparent protecting cylinder, thereby raising the temperature of the discharge tube so as to increase a vapor pressure of the enclosed metals and preventing an outer tube glass from breaking when the discharge tube is damaged.

In the metal halide lamps using a ceramic discharge tube, the tube-wall load of the discharge tube is raised compared to metal halide lamps having a quartz discharge tube, thereby achieving high efficiency and high color rendition. However, in order to realize high efficiency and high color rendition, it is necessary not only to raise the tube-wall load but also to keep the temperature in the discharge tube high. Accordingly, the transparent protecting cylinder or the like is used to maintain heat of the discharge tube.

On the other hand, in the metal halide lamps using a ceramic discharge tube, leaks in the discharge tube sealing portion caused by reactions of the enclosed metals with the sealing material and the lead-in wire serve as a considerable cause for dimming or dying out during the lamp lifetime. The conventional method for maintaining heat of the ceramic discharge tube of the metal halide lamps has had a problem in that, because the protecting cylinder surrounds the entire discharge tube, the temperature of the discharge tube sealing portion rises, leading to more reactivity of the enclosed metals with the sealing material and the lead-in wire. This increases the leaks in the discharge tube sealing portion during the lamp lifetime.

In addition, the metal halide lamps using a ceramic discharge tube have had a problem that the slender tube portions and the sealing portions of the discharge tube are damaged easily by a shock of dropping or the like.

SUMMARY OF THE INVENTION

It is an object of the present invention to solve the problems described above and to provide a metal halide lamp that suppresses leaks in a discharge tube sealing portion while maintaining high efficiency and high color rendition, which are features of a metal halide lamp using a ceramic discharge tube, and that is tolerant of an external shock.

In order to achieve the above-mentioned object, a metal halide lamp of the present invention includes an outer tube containing the ceramic discharge tube, and a protecting cylinder provided inside the outer tube so as to surround the discharge tube. The slender tube sealing portion of the discharge tube is exposed beyond the protecting cylinder.

Also, a metal halide lamp of the present invention includes a discharge tube of a transparent ceramic in which a discharge metal and a buffer gas are sealed, the discharge tube having electrodes at both ends thereof, including a discharge portion, slender tube portions provided at both ends of the discharge portion into which feedthroughs including the electrodes and lead-in wires are inserted, and slender tube sealing portions in which gaps between the slender tube portions and the feedthroughs are sealed with a sealing material; an outer tube containing the discharge tube; and a transparent protecting cylinder provided inside the outer tube so as to surround the discharge tube. At least one of the slender tube sealing portions is exposed beyond the protecting cylinder.

According to the present invention, heat is released appropriately from the sealing portions while keeping the temperature in the discharge tube high. Therefore, it is possible to suppress leaks in the discharge tube sealing portion while maintaining high efficiency and high color rendition.

DESCRIPTION OF THE PREFERRED EMBODIMENTS

In the present invention, at least one of the slender tube sealing portions is exposed beyond the protecting cylinder, and it is more preferable that both ends of the slender tube sealing portions are exposed beyond the protecting cylinder. The exposed length preferably ranges from 0.5 to 10 mm. The exposed length of shorter than 0.5 mm brings about less effect of decreasing the temperature of the slender tube sealing portion. That of longer than 10 mm causes an excessive decrease in the temperature of the slender tube sealing portion, leading to more undesirable variation of light colors.

In the metal halide lamp of the present invention, it is preferable that the protecting cylinder is supported within the outer tube by a support, and an elastic plate further is connected to the support so as to support the slender tube portions. Accordingly, the elastic plate is a metal, and thus a heat release from the slender tube sealing portion and an insulation against a heat from the discharge portion in the discharge tube are performed via the elastic plate, making it possible to lower the temperature of the sealing portion effectively. In addition, the slender tube portions in the discharge tube are supported by the elastic plate, thereby reducing a shock when the lamp is dropped and preventing the discharge tube from being damaged. The support mentioned above is for positioning the protecting cylinder in the outer tube, and can be a plate-like object or a band-like object.

Furthermore, in the metal halide lamp of the present invention, it is preferable that the slender tube sealing portions are provided outside a portion to be supported by the elastic plate. With this structure, a larger effect of the heat release and the heat insulation described above can be achieved, and an effect of suppressing leaks in the discharge tube sealing portion can be improved as well.

The following is a description of an embodiment of the present invention, with reference to the accompanying drawings.

Figure 1:
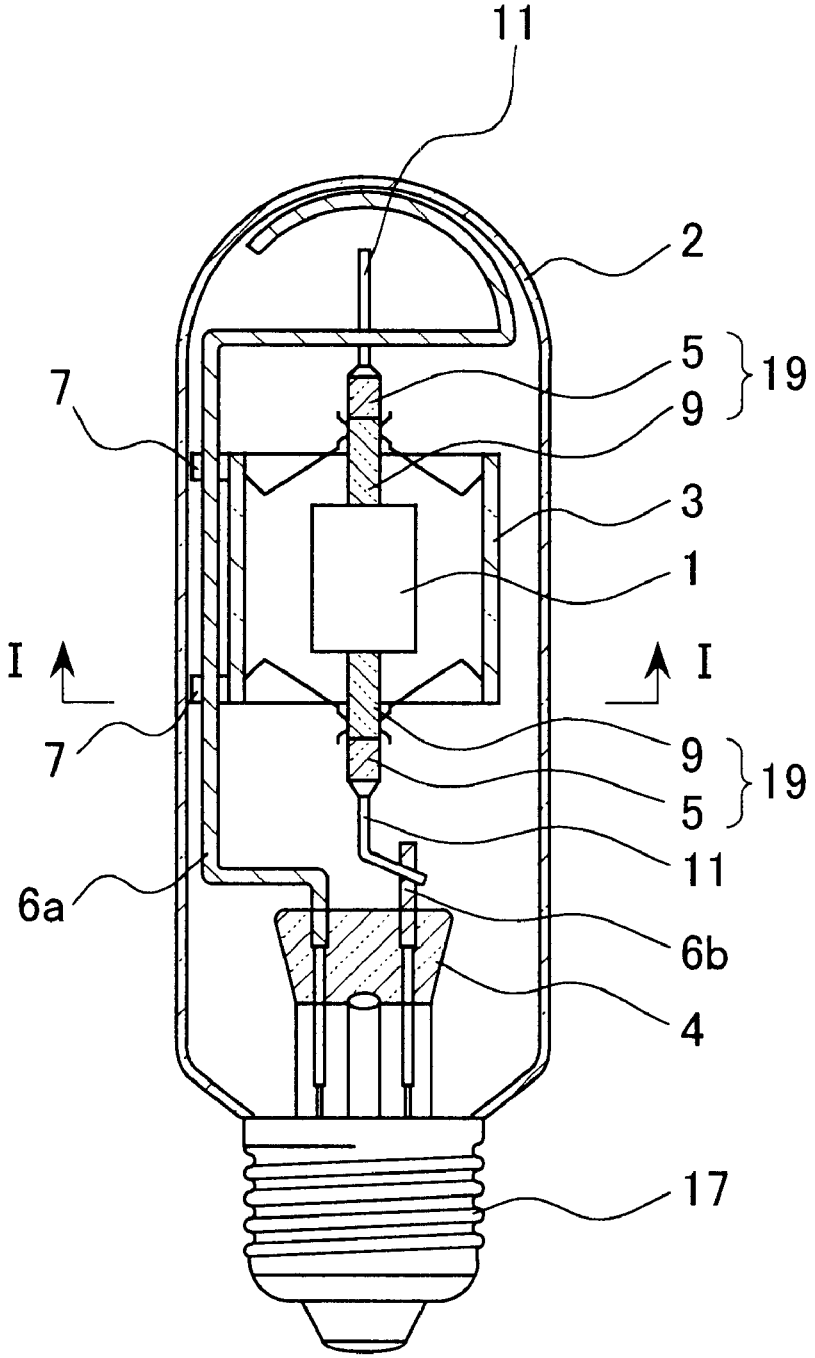
FIG. 1 is a partially broken front view showing a structure of a metal halide lamp in accordance with an embodiment of the present invention.
Figure 2:
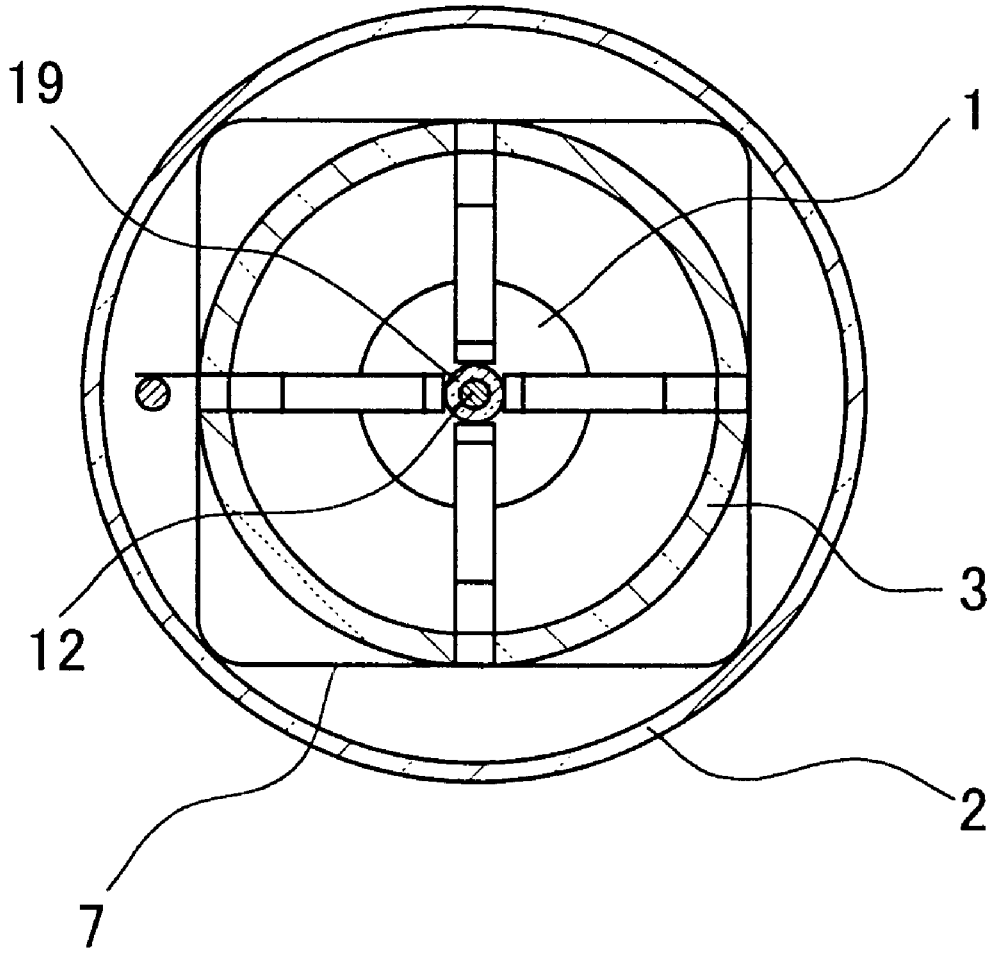
FIG. 2 is a cross-sectional view taken along a line I—I in FIG. 1.

A 70 W metal halide lamp illustrated in FIGS. 1 and 2, which is an embodiment of the present invention, has a structure in which a ceramic discharge tube 1 is rigidly supported by metal wires 6*a* and 6*b* inside an outer tube 2 and a transparent protecting cylinder 3 is supported rigidly by a support band 7 in such a manner as to surround the discharge tube 1. The support band 7 is fixed to the metal wire 6*a* by welding. The support band 7 can support the protecting cylinder 3 by holding four points on the outer periphery of the protecting cylinder 3 and position the protecting cylinder 3 at the center of the outer tube 2 by bringing four corners of the support band 7 into contact with an inner wall of the outer tube 2. One end of the outer tube 2 is provided with a stem 4, which seals the outer tube 2 air-tight. Nitrogen is filled at 46.5 kPa in the outer tube 2.

A predetermined amount of mercury, argon as a noble gas for a starting gas, and iodides of dysprosium, thulium, holmium, thallium and sodium as metal halides are sealed in the discharge tube 1. Numeral 9 indicates a slender tube gap portion, and numeral 17 indicates a lamp base.

Figure 3:
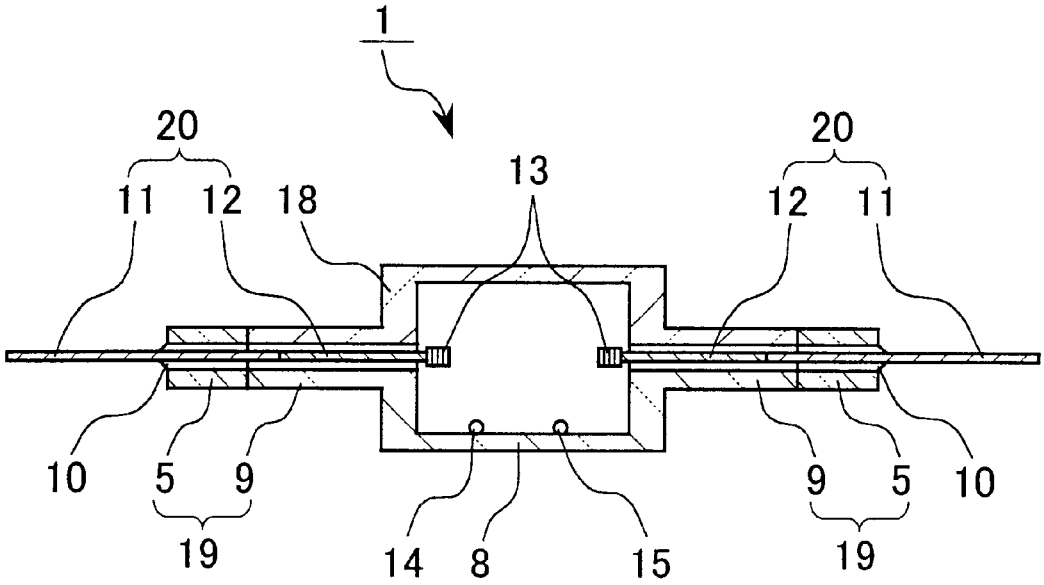
FIG. 3 is a cross-sectional view showing a structure of a discharge tube provided in the metal halide lamp described above.

As is shown in FIG. 3, the ceramic discharge tube 1 includes slender tube portions 19 on both end portions of a main tube portion 8. The main tube portion 8 and the slender tube portions 19 are sintered into one piece with ring portions 18.

A feedthrough 20 constituted by an electrode 12 and a lead-in wire 11 made of electrically conductive cermet having an outer diameter of 0.7 mm is inserted into each of the slender tube portions 19. The feedthroughs 20 are sealed with a sealing material 10 in the slender tube portions 19 so that the tips of the electrodes 12 are positioned inside the main tube portion 8, and slender tube sealing portions 5 are formed in the slender tube portions 19. Electrode coils 13 are welded to the tips of the electrodes 12. Numeral 14 indicates a mercury pellet, and numeral 15 indicates an iodide pellet.

Figure 4:
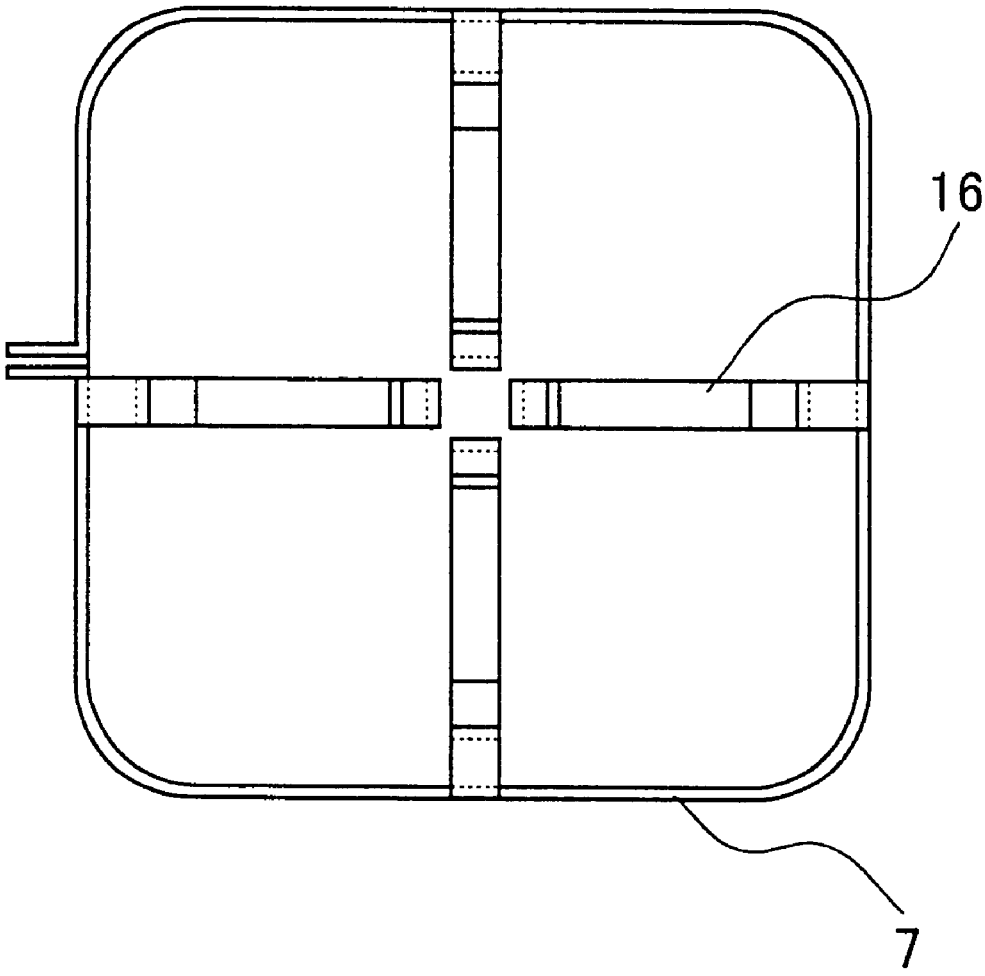
FIG. 4 is a plan view showing a structure of a support band provided in the metal halide lamp described above.
Figure 5:
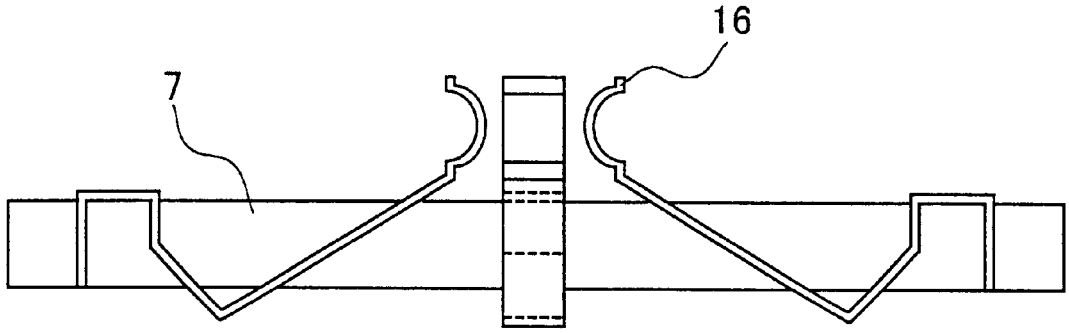
FIG. 5 is a cross-sectional view showing the structure of the support band provided in the metal halide lamp described above.

In accordance with the structure described above, Conventional Example A in which the protecting cylinder 3 surrounded the entire discharge tube 1, Structure B in which the slender tube sealing portions 5 were exposed beyond the protecting cylinder 3 by 2 mm, Structure C in which elastic plates 16 were added to the support band 7 of Structure B so as to support the slender tube portions 19 of the discharge tube 1 as shown in FIGS. 4 and 5, and Structure D in which the slender tube sealing portions 5 were provided outside a portion to be supported by the elastic plates 16 in Structure C as shown in FIG. 5 were prepared. For these structures, the occurrence of leaks in the discharge tube sealing portions (sample number n=35) was examined after 6000 hours of operation during lifetime. Table 1 shows the results of these measurements.

TABLE 1

| Structure | Occurrence of Leaks (%) |
|---|---|
| A | 20 |
| B | 9 |
| C | 5 |
| D | 3 |

As becomes clear from Table 1, Structures B, C and D made it possible to suppress the occurrence of leaks in the discharge tube sealing portions to 50% or less compared to that of Conventional Example A.

This was because, by exposing the slender tube sealing portions 5 beyond the protecting cylinder 3, the temperature of the slender tube sealing portions 5 decreased, leading to less reactivity of the enclosed metals with the sealing material 10 and the lead-in wire 11. The result for Structure C was attributable to the further temperature decrease in the slender tube sealing portions 5 caused by adding the elastic plates 16 to the support band 7 so as to support the slender tube portions 19 of the discharge tube 1. Moreover, the result for Structure D was attributable to the further temperature decrease in the slender tube sealing portions 5 caused by providing the slender tube portions 5 outside the portion to be supported by the elastic plates 16.

When Structures B, C and D were chosen, lamp characteristics did not change very much and high efficiency and high color rendition were maintained.

Next, drop tests were conducted for both cases with and without the elastic plates 16 attached to the support band 7. In the test method, lamps were wrapped up with two layers of cardboard sheaths and then dropped from 60 cm. It was found that four out of ten discharge tubes without the elastic plates were damaged, while none of the ten tubes having the elastic plates were damaged.

As described above, according to the present invention, it is possible to suppress leaks in the discharge tube sealing portion while maintaining high efficiency and high color rendition of the lamp and prevent the discharge tube from being damaged by the shock of dropping or the like.

Although the electrically conductive cermet was used as the lead-in wires 11 of the slender tube portion 19 in the above embodiment, other materials having a thermal expansion coefficient close to that of the discharge tube material may be used for the lead-in wires instead of the electrically conductive cermet. Also, a non-conductive ceramic cap may be used for the sealing portion. Moreover, the main tube portion of the discharge tube and the ring portions also may be molded in one piece, and then sintered into one piece with the slender tube portions, so as to form the discharge tube. Furthermore, the discharge tube may be used in which the main tube portion of the discharge tube, the slender tube portions and the ring portions are molded in one piece.

Although nitrogen gas was filled in the outer tube 2 in the above-described embodiment, a mixed gas containing nitrogen may be filled. For example, Ne (neon) gas can be mixed with nitrogen and filled into the outer tube 2. When using such mixed gas, it is preferable that the nitrogen gas accounts for at least 50 vol %.

In the present invention, the ceramic material used for the discharge tube is not limited specifically. For example, it is possible to use sapphire as a single-crystal metallic oxide, alumina ($Al_2O_3$), yttrium-aluminum-garnet (YAG) or yttrium oxide (YOX) as a polycrystal metallic oxide, or aluminum nitride (AlX) as a polycrystal nonoxide.

In addition, in the above embodiment, a hard glass was used for the outer tube. However, the material used for the outer tube in the present invention is not limited specifically, but can be any known material.

As described above, the present invention can provide a metal halide lamp that suppresses leaks in a discharge tube sealing portion while maintaining high efficiency and high color rendition of the lamp and that is tolerant of an external shock, and therefore is valuable in industry.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal halide lamp comprising:

a discharge tube of a transparent ceramic in which a discharge metal and a buffer gas are sealed, the discharge tube having electrodes at both ends thereof, comprising;

a discharge portion, slender tube portions provided at both ends of the discharge portion, into which feedthroughs comprising the electrodes and lead-in wires are inserted, and slender tube sealing portions in which gaps between the slender tube portions and the feedthroughs are sealed with a sealing material;

an outer tube containing the discharge tube; and a transparent protecting cylinder provided inside the outer tube so as to surround the discharge tube;

wherein at least one of the slender tube sealing portions is exposed beyond the protecting cylinder.

2. The metal halide lamp according to claim 1, wherein the protecting cylinder is supported within the outer tube by a support.

3. The metal halide lamp according to claim 2, wherein an elastic plate further is connected to the support so as to support the slender tube portions.

4. The metal halide lamp according to claim 3, wherein the slender tube sealing portions are provided outside a portion to be supported by the elastic plate.

5. The metal halide lamp according to claim 3, wherein the elastic plate is a metal, and a heat release from the slender tube sealing portion and an insulation against a heat from the discharge portion in the discharge tube are performed by the elastic plate.

6. The metal halide lamp according to claim 3, wherein the slender tube portions in the discharge tube are supported by the elastic plate, thereby reducing a shock when the lamp is dropped.

7. The metal halide lamp according to claim 2, wherein the support is selected from the group consisting of a plate-like object and a band-like object, and positions the protecting cylinder in the outer tube.

8. The metal halide lamp according to claim 1, wherein the ceramic discharge tube is rigidly supported by metal wires inside the outer tube.

9. The metal halide lamp according to claim 1, wherein one end of the outer tube further is provided with a stem, which seals the outer tube air-tight.

10. The metal halide lamp according to claim 1, wherein mercury, argon as a noble gas for a starting gas, and at least one iodide selected from the group consisting of dysprosium, thulium, holmium, thallium and sodium as a metal halide are sealed in the discharge tube.

11. The metal halide lamp according to claim 1, wherein a main tube portion surrounding the discharge portion, a pair of the slender tube portions connected to the main tube portion, into which the lead-in wires for feeding an electricity to the electrodes are inserted, the slender tube portion having a tip that is sealed, and ring portions connecting the main tube portion and the slender tube portions are sintered into one piece so as to form the ceramic discharge tube.

12. The metal halide lamp according to claim 11, wherein the slender tube portion has a slender tube gap portion on a side of the main tube portion.

* * * * *